US005304047A

United States Patent [19]

Shibamoto

[11] Patent Number: 5,304,047

[45] Date of Patent: Apr. 19, 1994

[54] SCROLL COMPRESSOR OF TWO-STAGE COMPRESSION TYPE HAVING AN IMPROVED VOLUMETRIC EFFICIENCY

[75] Inventor: Yoshitaka Shibamoto, Sakai, Japan

[73] Assignee: Daikin Industries, Ltd., Osaka, Japan

[21] Appl. No.: 936,664

[22] Filed: Aug. 28, 1992

[30] Foreign Application Priority Data

Aug. 30, 1991 [JP] Japan ..... 3-220169

[51] Int. Cl.[5] ..... F04C 18/04; F04C 23/00

[52] U.S. Cl. ..... 418/5; 418/55.2; 418/60

[58] Field of Search ..... 418/5, 55.2, 60

[56] References Cited

U.S. PATENT DOCUMENTS 4,650,405 3/1987 Iwanami et al. ..... 418/5

FOREIGN PATENT DOCUMENTS 61-152984 7/1986 Japan .

1-138387 5/1989 Japan ..... 418/55.2

*Primary Examiner*—John J. Vrablik

[57] ABSTRACT

A scroll compressor has first, second and third scrolls. The second and third scrolls each have a spiral ridge on a flat plane and the first scroll has two spiral ridges on opposite sides of a flat plate. The second and third scrolls are arranged on both sides of the first scroll so that the spiral ridges of the opposed scrolls are meshed with each other. A lower-stage compression part is defined between the first and second scrolls and a higher-stage compression part is defined between the first and third scrolls. A suction port of the lower-stage compression part communicates with a suction passage of the compressor, a discharge port of the lower-stage compression part communicates with a suction port of the higher-stage compression part, and a discharge port of the higher-stage compression part communicates with a discharge passage of the compressor. Thus, a fluid on the suction passage is first sucked into the lower-stage compression part and compressed there to an intermediate pressure, then further compressed to a higher pressure at the higher-stage compression part, and finally discharged from the discharge port of the higher-stage compression part to the discharge passage.

10 Claims, 9 Drawing Sheets

SCROLL COMPRESSOR OF TWO-STAGE COMPRESSION TYPE HAVING AN IMPROVED VOLUMETRIC EFFICIENCY

BACKGROUND OF THE INVENTION

1. Field of the Invention

The present invention generally relates to a scroll compressor primarily used for a refrigerating apparatus, and more particularly to a scroll compressor comprising a first scroll, and second and third scrolls arranged on both sides of and associated with the first scroll so that two compression chambers are provided.

2. Description of the Prior Art

A conventional scroll compressor of this kind is disclosed in FIG. 9. As shown in FIG. 9, the conventional scroll compressor comprises a first scroll 102, a second scroll 103 and a third scroll 104. The first scroll 102 has a flat plate 121 and back and front spiral ridges 122*a*, 122*b* provided on both sides of the flat plate 121, respectively. The second scroll 103 has an end plate with a flat face 131 confronting one face of the flat plate 121, and a spiral ridge 132 provided on the flat face 131. Similarly, the third scroll 104 has an end plate with a flat face 141 confronting the other face of the flat plate 121 of the first scroll 102, and a spiral ridge 142 provided on the flat face 141. The second and third scrolls 103, 104 are arranged on both sides of the first scroll 102 in a manner to sandwich the first scroll 102 therebetween. Thus, the back spiral ridge 122*a* of the first scroll 102 and the spiral ridge 132 of the second scroll 103 are meshed with each other, while the front spiral ridge 122*b* of the first scroll 102 and the spiral ridge 142 of the third scroll 104 are meshed with each other. Suction ports 105, 105 are respectively formed in the vicinity of the external end portions of the back spiral ridge 122*a* of the first scroll 102 and the spiral ridge 132 of the second scroll 103 and in the vicinity of the external end portions of the front spiral ridge 122*b* of the first scroll 102 and the spiral ridge 142 of the third scroll 104. The suction ports 105 communicate with a suction space 106 in a casing 101 being a low-pressure dome. On the other hand, discharge ports 108, 108 are respectively formed in the vicinity of the internal end portions of the back spiral ridge 122*a* of the first scroll 102 and the spiral ridge 132 of the second scroll 103 and in the vicinity of the internal end portions of the front spiral ridge 122*b* of the first scroll 102 and the spiral ridge 142 of the third scroll 104. The discharge ports 108 communicate with a discharge passage 107. Compression portions 109, 109 are defined between the spiral ridges 122*a* and 132, 122*b* and 142. In this scroll compressor, a fluid taken in from the respective suction ports 105 and compressed at the respective compression portions 109 is joined at the discharge ports 108 and then discharged through the discharge passage 107 communicating with the discharge ports 108.

As described above, in the conventional scroll compressor, the suction and compression operation is effected on both sides of the first scroll 102. Therefore, a thrust load acting on the first scroll 102 is offset by the balance between fluid pressures at the compression chambers formed on both sides of the first scroll 102, so that a thrust load acting on a thrust bearing of the first scroll 102 can be reduced, resulting in reduction of loss at the thrust bearing. In addition, the capacity of the compressor can be increased.

However, since a fluid, which is in the suction space 106 in the casing 101 designed as a low-pressure dome, is taken in from the two suction ports 105 communicating with the suction space 106, and compressed at the two compression portions 109 in parallel and then discharged from the two discharge ports 108 to the discharge passage 107, the volumetric efficiency cannot be effectively increased. More specifically, since a vicinity zone of the external end portions of the spiral ridges 122*a* and 132 and that of the external end portions of the spiral ridges 122*b*, 142 are both placed in an atmosphere of a suction pressure, both of the compression portions 109 having completed the fluid suction and containment processes are necessarily adjacent to the suction space 106. As a result, as shown in FIG. 10, the fluid under compression in the two compression portions 109 leaks to the suction space 106 through clearances between end faces of the external end portions of the spiral ridges 122*a*, 122*b* of the first scroll 102 and the flat faces 131, 141 of the end plates of the second and third scrolls 103, 104, respectively. Since this leakage takes place on both sides of the first scroll 102, the volumetric efficiency decreases.

SUMMARY OF THE INVENTION

The present invention has been developed in view of the above-mentioned problem, and an essential object of the present invention is to provide a scroll compressor which is capable of reducing the volumetric efficiency drop due to the leakage of fluid in the process of compression to the suction passage, while reducing the thrust load effectively, so that a higher volumetric efficiency is offered as compared with the conventional scroll compressor.

In order to achieve the aforementioned object, the present invention provides a scroll compressor which comprises a first scroll having a flat plate and first and second spiral ridges provided on opposite faces of the flat plate; a second scroll having an end plate with a flat face and a spiral ridge provided on the flat face of the end plate, the second scroll being placed on one side of the first scroll so that the flat face of the end plate is opposed to one face of the flat plate of the first scroll and that the spiral ridge of the second scroll is meshed with the first spiral ridge of the first scroll; a third scroll having an end plate with a flat face and a spiral ridge provided on the flat face of the end plate of the third scroll, the third scroll being placed on the other side of the first scroll so that the flat face of the end plate of the third scroll is opposed to the other face of the flat plate of the first scroll and that the spiral ridge of the third scroll is meshed with the second spiral ridge of the first scroll; a casing accommodating the first, second and third scrolls and having an internal space therein; a suction passage for introducing a fluid to be compressed into the casing; and a discharge passage for discharging a compressed fluid out of the casing, and which is characterized in that:

a lower-stage compression part provided with a suction port and a discharge port is formed between the first and second scrolls, the suction port of the lower-stage compression part being formed in the vicinity of external end portions of the first spiral ridge of the first scroll and the spiral ridge of the second scroll and communicating with the suction passage;

a higher-stage compression part provided with a suction port and a discharge port is formed between the first and third scrolls, the discharge port of the higher-stage compression part being formed in the vicinity of internal end portions of the second spiral ridge of the first scroll and the spiral ridge of the third scroll and communicating with the discharge passage; and the discharge port of the lower-stage compression part communicates with the suction port of the higher-stage compression part, whereby the fluid is first compressed to a predetermined intermediate pressure at the lower-stage compression part and then the fluid is further compressed to a higher pressure at the higher-stage compression part.

According to the present invention, there is provided a scroll compressor of two-stage compression type. That is, a fluid sucked from the suction port of the lower-stage compression part is compressed to an intermediate pressure and discharged from the discharge port of the lower-stage compression part. This discharged fluid is then sucked from the suction port of the higher-stage compression part so as to be further compressed to a higher pressure by the higher-stage compression part. The fluid is finally discharged from the discharge port into the discharge passage.

In the lower-stage compression part, leakage of the fluid in the process of compression into the suction passage still takes place as in the conventional scroll compressor, but in the higher-stage compression part, since the fluid once compressed by the lower-stage compression part is sucked from the lower-stage compression part for further compression, there is no leakage of the fluid in the process of compression into the suction passage, and therefore, the volumetric efficiency drop due to the leakage of the fluid in the process of compression can be reduced while the thrust load acting on the first scroll can be effectively reduced. Thus, a high-efficiency scroll compressor can be obtained.

Preferably, the discharge port of the lower-stage compression part and the suction port of the higher-stage compression part open into the casing accommodating the lower-stage compression part and higher-stage compression part so that the discharge port of the lower-stage compression part and the suction port of the higher-stage compression part communicate with each other through the internal space of the casing, and the discharge port of the higher-stage compression part communicates with the discharge passage while being separated from the internal space.

In this case, the internal space of the casing can be held at an intermediate pressure between a low pressure and a high pressure, and can be utilized as a communication passage between the lower-stage compression part and the higher-stage compression part. Therefore, the construction of passages can be simplified. Furthermore, when a motor for driving the movable scroll is accommodated in the internal space, the motor can be effectively cooled by the intermediate-pressure fluid. Therefore, a better cooling effect for the motor can be obtained as compared with a so-called high-pressure dome type compressor wherein the internal space of the casing is held at a high pressure, whereby reliability of the motor can be improved and efficiency drop of the motor can be suppressed. Moreover, as compared with a so-called low-pressure dome type compressor wherein the internal space is held at a low pressure, the effect of the superheat of a suction gas due to the overheat of the motor can be reduced. Furthermore, since a lubrication oil for lubricating parts such as a bearing for supporting a shaft driven by the motor can be easily added to the intermediate-pressure fluid after the lubrication has been effected, a special oil injection mechanism for a compression chamber of the higher-stage compression part can be eliminated, and since the lubrication oil is added to the intermediate-pressure fluid, the superheat of the suction fluid is less and the volumetric efficiency drop is also less, as compared with the case of adding lubrication oil to the suction fluid.

Furthermore, when the flat plate of the first scroll is provided with a communication passage for communicating the discharge port of the lower-stage compression part with the suction port of the higher-stage compression part, and the discharge port of the higher-stage compression part opens into the internal space of the casing accommodating therein the lower-stage compression part and the higher-stage compression part, the internal space can be held at a high pressure. Therefore, the differential pressure oil supply to lubrication parts can be easily made. Since the lubrication parts are also held at the high pressure, pressures are balanced on both sides of the first scroll, resulting in that the thrust load acting on the first scroll can be made smaller.

BRIEF DESCRIPTION OF THE DRAWINGS

These and other objects and features of the present invention will become clear from the following description taken in conjunction with the preferred embodiments thereof with reference to the accompanying drawings, throughout which like parts are designated by like reference numerals, and in which.

DETAILED DESCRIPTION OF THE PREFERRED EMBODIMENTS

Figure 1:
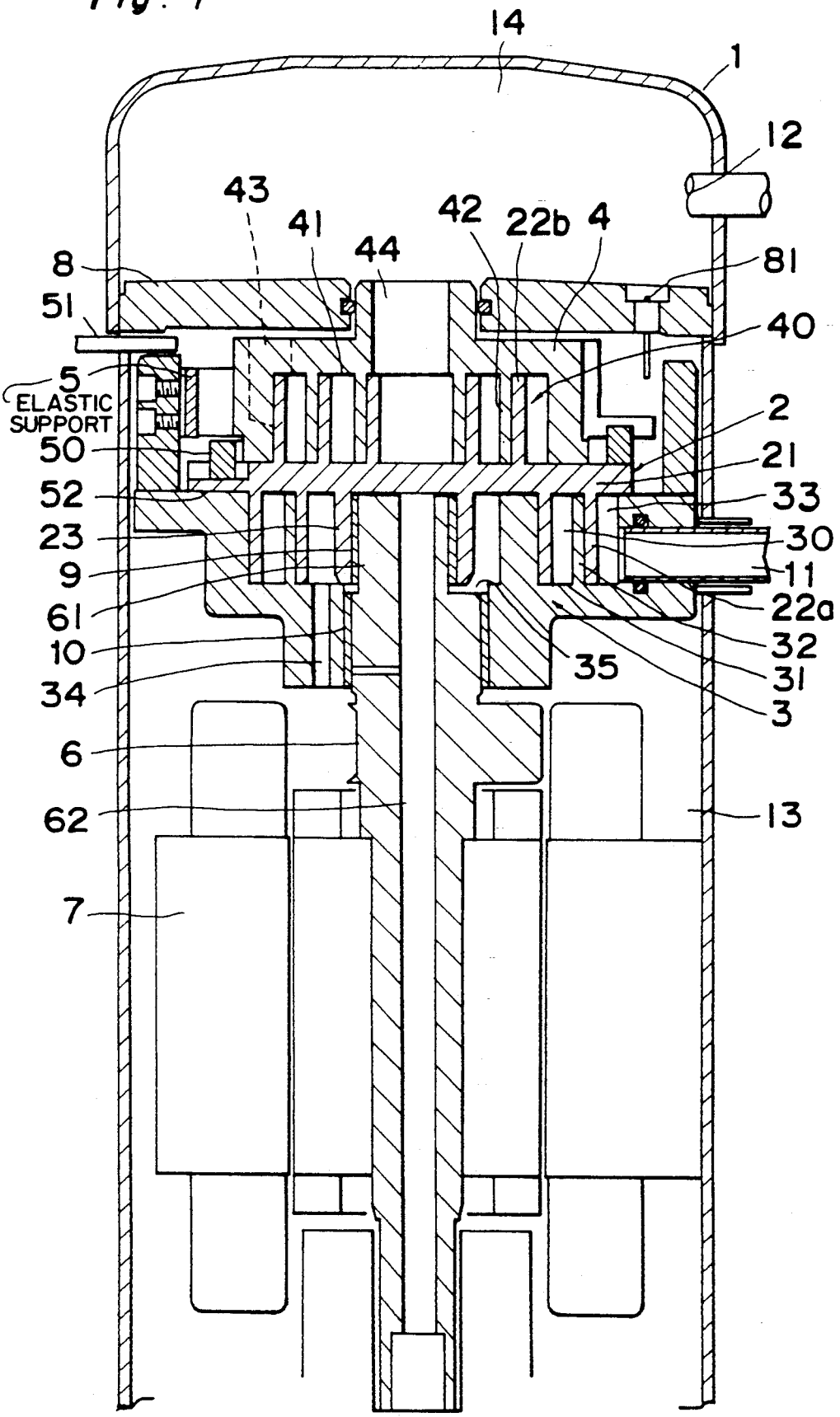
FIG. 1 is a partly-omitted longitudinal sectional view of a first embodiment of a scroll compressor according to the present invention.

At first, a first embodiment shown in FIG. 1 will be described below. In FIG. 1, reference numeral 1 indicates a hermetic casing having a suction passage 11 and a discharge passage 12. Reference numeral 2 indicates a first scroll which has a flat plate 21 and back and front spiral ridges 22*a*, 22*b* provided as first and second spiral ridges respectively on both faces of the flat plate 21.

Reference numeral 3 indicates a second scroll which has an end plate having a flat plane 31 opposed to one face of the flat plate 21 of the first scroll 2, and a spiral ridge 32 formed on the flat plane 31. Reference numeral 4 indicates a third scroll which has an end plate having a flat plane 41 opposed to the other face of the flat plate 21 of the first scroll 2, and a spiral ridge 42 formed on the flat plane 41. The second and third scrolls 3, 4 are arranged on both sides of the flat plate 21 of the first scroll 2 so as to mesh the back spiral ridge 22*a* of the first scroll 2 with the spiral ridge 32 of the second scroll 3 and to mesh the front spiral ridge 22*b* of the first scroll 2 with the spiral ridge 42 of the third scroll 4. The second scroll 3 is fixed within the casing 1 and the third scroll 4 is supported on the casing 1 by an elastic support means 5 so as to be displaceable in a radial direction of the first scroll 2. The first scroll 2 is mounted around a drive shaft 6 connected to an associated motor 7 so as to orbit.

Figure 3:
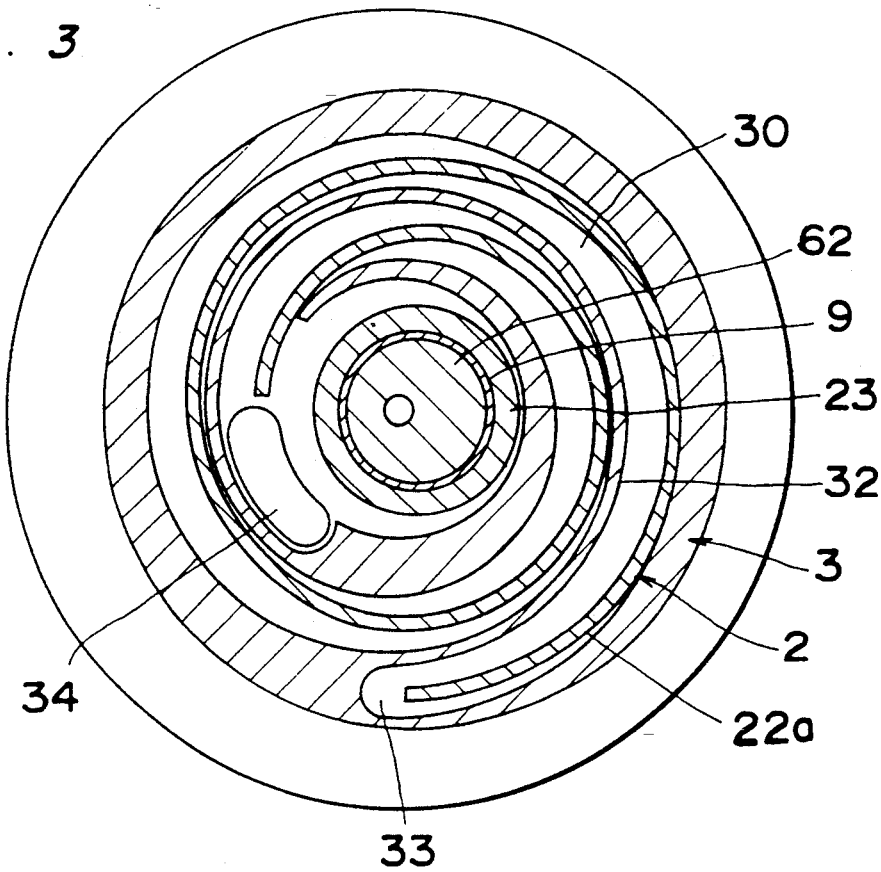
FIG. 3 is a cross-sectional view of a lower-stage compression part of the scroll compressor of FIG. 1.
Figure 4:
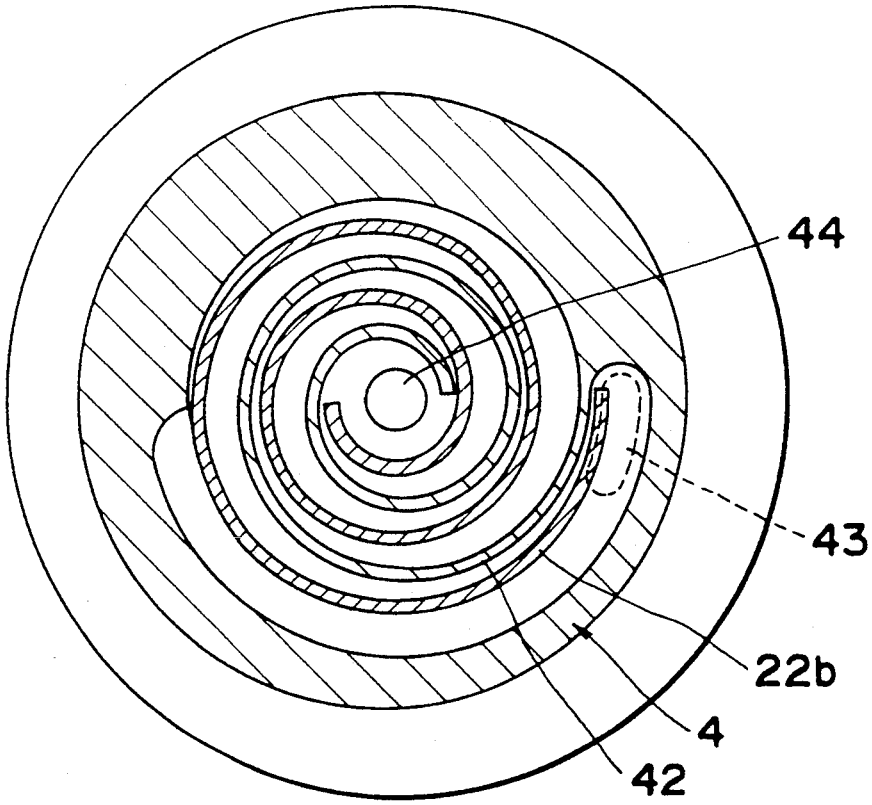
FIG. 4 is a cross-sectional view of a higher-stage compression part of the scroll compressor of FIG. 1.

As shown in FIGS. 1 and 3, a suction port 33 communicating to the suction passage 11 is provided in the vicinity of the external end portions of the back spiral ridge 22*a* of the first scroll 2 and the spiral ridge 32 of the second scroll 3 meshed with the back spiral ridge 22*a*, and a discharge port 34 is provided in the vicinity of the internal end portions of the back spiral ridge 22*a* of the first scroll 2 and the spiral ridge 32 of the second scroll 3, so that a lower-stage compression part 30 is defined between the first and second scrolls 2 and 3. On the other hand, as shown in FIGS. 1 and 4, another suction port 43 is provided in the vicinity of the external end portions of the front spiral ridge 22*b* of the first scroll 2 and the spiral ridge 42 of the third scroll 4 meshed with the front spiral ridge 22*b*, and near the internal end portions thereof there is provided a discharge port 44 communicating to the discharge passage 12. Thus a higher-stage compression part 40 is formed between the first and third scrolls 2 and 4. The discharge port 34 of the lower-stage compression part 30 and the suction port 43 of the higher-stage compression part 40 open into an internal space 13 of the casing 1 accommodating the lower-stage compression part 30 and higher-stage compression part 40, so that the discharge port 34 and the suction port 43 communicate with each other through the internal space 13. The discharge port 44 of the higher-stage compression part 40 opens into a high pressure space 14 isolated from the internal space 13 by a partition wall 8, with the discharge passage 12 communicating with this high pressure space 14.

Figure 2:
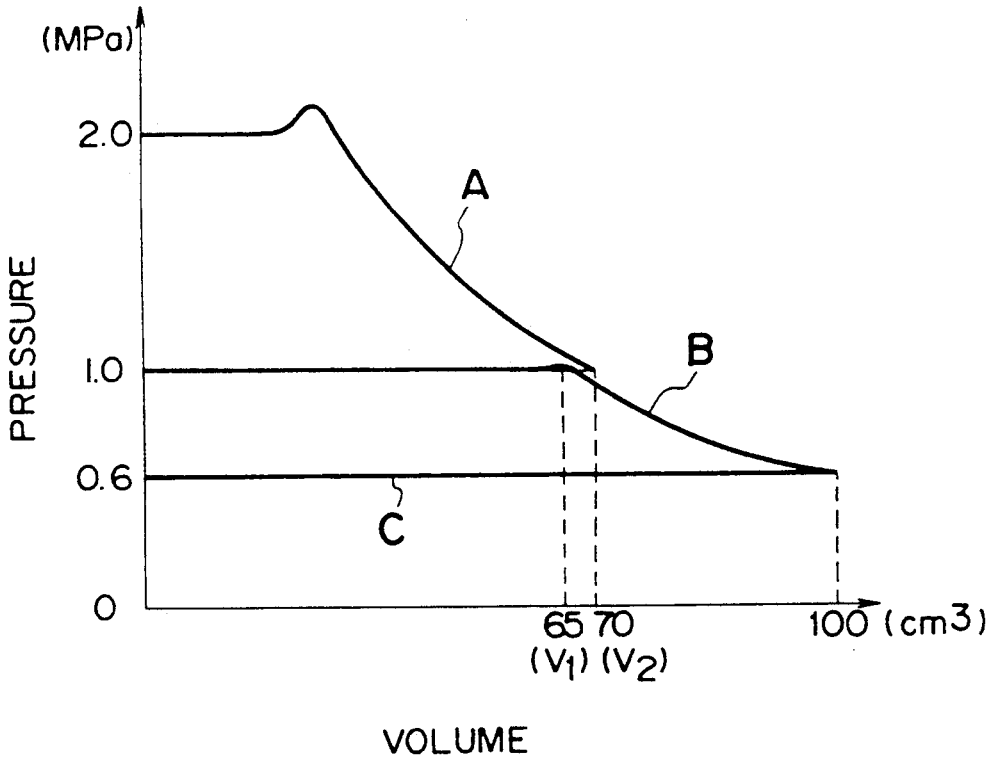
FIG. 2 is an explanatory diagram showing the relation between the volume and pressure at the lower-stage compression part and the higher-stage compression part.

A discharge volume of the lower-stage compression part 30 (a volume of a compression chamber of the lower-stage compression part 30 reached immediately before the discharge is started) and a suction volume of the higher-stage compression part 40 are ideally equal to each other. Actually, however, taking errors, etc. into consideration, the discharge volume $V_1$ of the lower-stage compression part 30 is preferably made a little smaller than the suction volume $V_2$ of the higher-stage compression part 40, as shown in FIG. 2 wherein a curve A indicates a discharge pressure of the higher-stage compression part 40, a curve B indicates a discharge pressure of the lower-stage compression part 30 and a curve C indicates a suction pressure of the lower-stage compression part 30. Furthermore, when gas injection is made possible as described later, the suction volume $V_2$ is preferably made, for example, 1.1 to 1.3 times the discharge volume $V_1$ in accordance with the gas injection volume.

Between the third scroll 4 and the flat plate 21 of the first scroll 2, there is provided an Oldham joint 50 to allow the first scroll 2 to revolve through driving of the drive shaft 6. The first scroll 2 has in its central portion on the second scroll side a tubular boss portion 23 to receive an eccentric portion 61 of the drive shaft 6 through a bearing 9. The bearing 9 portion communicates with the discharge port 34 of the lower-stage compression part 30 by means of a communication passage 35, so that oil can be injected into the lower-stage compression part 30 through the communication passage 35 after being supplied to the bearing 9 from an oil supply passage 62 which is provided in the central portion of the drive shaft 6 and which communicates with an oil supply pump (not shown). An intermediate portion of the drive shaft 6 is rotatably supported in a bearing hole provided in a central portion of the second scroll 3 through a bearing 10. The discharge port 34 is opened near the bearing 10 so that a lubrication oil injected into the lower-stage compression part 30 through the communication passage 35 can be returned from the discharge port 34 to the internal space 13 together with an intermediate-pressure gas.

The intermediate pressure gas discharged from the discharge port 34 into the internal space 13 effectively cools the motor 7, and reaches the suction port 43 of the higher-stage compression part 40 through a clearance between an outer periphery of the second scroll 3 and an inner wall of the hermetic casing 1 so as to be sucked into the higher-stage compression part 40 from its suction port 43. At this time, the oil having been injected into the intermediate-pressure gas is separated therefrom through collision of the gas with the motor and effectively returned to an oil reservoir placed at the bottom of the casing 1. Oil not separated is, in the process of being sucked into the suction port 43, supplied to a sliding portion of the Oldham joint 50 and the bearings 9, 10 for the first and second scrolls 2 and 3.

Furthermore, the elastic support means 5 for supporting the third scroll 4 are constituted from, for example, coil springs, leaf springs, etc., and support the third scroll 4 at its plural peripheral positions so as to allow the third scroll 4 to displace radially relative to the first scroll 2.

Furthermore, the partition wall 8 is provided with an oil return passage 81 which opens to the internal space 13 so as to return oil separated from a high-pressure gas in the high pressure space 14 to the internal space 13.

Meanwhile, reference numeral 51 indicates an injection tube opening into the internal space 13 near the suction port 43 of the higher-stage compression part 40. The injection tube 51 can inject gas, liquid or oil to the internal space 13 near the suction port 43 so that the amount of gas sucked by the higher-stage compression part 40 is increased, resulting in an increase in capacity of the compressor, or that the higher-stage compression part 40 is cooled or sealed. In this case, since the injection tube 51 is required only to be projected into the casing 1, the piping structure of the injection tube 51 can be simplified. Particularly in the case of injection of gases, since the injection is effected into the internal space 13, namely, into the internal space wherein pressure can be held constant with little change according to the operating condition, the volume of injection can be held almost constant and the back flow of the gas, loss due to the back flow and injection pulsation can be eliminated. By contrast, in the conventional example wherein an injection port is provided in a fixed scroll and wherein the gas injection is effected during the compression process, the injection pressure may become lower than the pressure of the compression chamber according to the operation condition, resulting in occurrence of the back flow.

The compressor of the first embodiment constructed as shown in FIG. 1 operates as follows. When the first scroll 2 is driven to revolve by the motor 7, a low-pressure gas taken into the suction port 33 from the suction passage 11 is compressed to an intermediate pressure in the compression chamber of the lower-stage compression part 30, and discharged from the discharge port 34 into the internal space 13 of the casing 1. The intermediate-pressure gas in the internal space 13 is sucked from the suction port 43 into the higher-stage compression part 40, compressed in the compression chamber of the higher-stage compression part 40, and then discharged into the high-pressure space 14 to be delivered to the discharge passage 12. That is, the compressor is of a two-stage compression construction wherein a gas first compressed by the lower-stage compression part 30 to an intermediate-pressure is further compressed to a high pressure by the higher-stage compression part 40. Therefore, although the gas leaks from the lower-stage compression part 30 into the suction passage 11 in the process of compression as in the conventional case, there is no leakage from the higher-stage compression part 40 to the suction passage 11. Because of this fact, the volumetric efficiency drop due to the leakage of the gas in the process of compression into the suction passage 11 can be reduced. Furthermore, since the lower-stage compression part 30 and the higher-stage compression part 40 communicate with each other through the internal space 13 of the casing 1, namely, the internal space 13 is utilized as a communication passage, the passage construction can be simplified. And since the intermediate-pressure gas between the low pressure and the high pressure is discharged into the internal space 13, the motor 7 driving the first scroll 2 can be effectively cooled by the intermediate pressure gas. Consequently, as compared with a so-called high-pressure dome compressor wherein the internal space in the casing is held at a high pressure, a better cooling effect for the motor 7 can be obtained, reliability of the motor can be improved, and drop in motor efficiency can be restrained. Furthermore, effect of superheat of a suction gas due to overheating of the motor can be less, as compared with a so-called low-pressure dome compressor wherein the internal space is held at a low pressure.

In the first embodiment described above, since oil supplied to the bearing 9 can be easily injected into the lower-stage compression part 30 and the injected oil can be returned to the internal space 13 from the discharge port 34 together with the intermediate-pressure gas, oil return can be performed effectively and easily. Moreover, although oil is returned to the internal space 13, the suction gas in the internal space 13 is hardly superheated since the internal space 13 is at an intermediate pressure. Also, part of the returned oil is utilized to lubricate the sliding portion of the Oldham joint 50, a thrust bearing 52 and other parts.

Furthermore, in the case of gas injection from the injection tube 51, not only the piping structure can be simplified, but also a stable injection becomes possible as described above. In addition, oil is injected into the higher-stage compression part 40 and the sliding portion of the Oldham joint 50, the thrust bearing 52, etc. are lubricated while the oil is returned from the high pressure space 14 to the internal space 13 by providing the oil return passage 81 in the partition wall 8.

Furthermore, since the intermediate-pressure gas discharged from the lower-stage compression part 30 is further compressed to a high pressure, it is not necessary to make the overall diameter of the higher-stage compression part 40 as large as that of the lower-stage compression part 30. As a result, the Oldham joint 50 can be easily mounted by utilizing the outer periphery of the higher-stage compression part 40.

Furthermore, the third scroll 4 is elastically supported through the elastic support means 5. Therefore, when there is a dimensional error in a portion of the drive shaft 6 which supports the third scroll 4 and the eccentric shaft portion 61 of the shaft 6, the third scroll 4 is displaced in the radial direction relative to the first scroll 2 during the revolution of the first scroll 2 so that the contact resistance between the spiral ridges **22*b*, 42 of the first and third scrolls 2 and 4 is reduced. Moreover, when a fluid is compressed in a liquid-phase in the higher-stage compression part 40 or when dust enters between the spiral ridges 22*b*, 42, the third scroll 4 is displaced in the radial direction relative to the first scroll 2, thus preventing the contact resistance between spiral ridges 22*b* and 42** from increasing.

Figure 5:
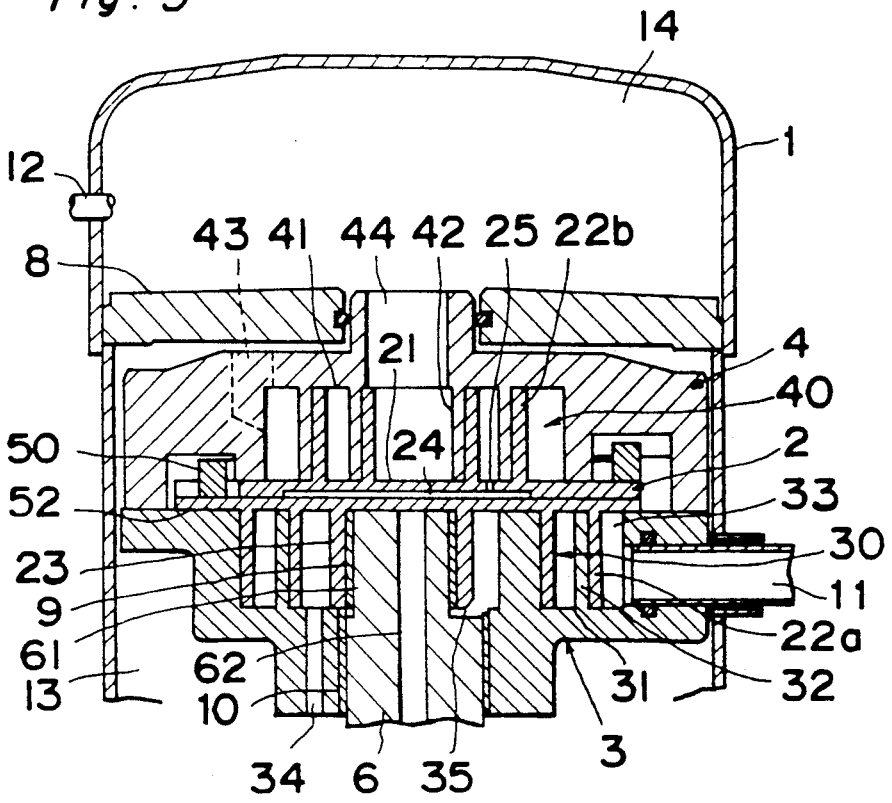
FIG. 5 is a partial longitudinal sectional view of a variant of the first embodiment of the present invention.

Furthermore, in the first embodiment shown in FIG. 1, it is preferable to further provide in the flat plate 21 of the first scroll 2 a heat insulation space 24 having a size nearly equal to the outer diameters of the spiral ridges **22*b*, 42 as shown in FIG. 5; and it is further preferable to provide a small-diameter communication passage 25 communicating the heat insulation space 24 in the flat plate 21 with the higher-stage compression part 40 so as to introduce into the heat insulation space 24 through the passage 25 an intermediate-temperature gas being compressed in the higher-stage compression part 40. In this case, since heat transfer from the higher-stage compression part 40 to the lower-stage compression part 30 due to the temperature difference between these compression parts 30 and 40 can be suppressed, loss in compression due to the heat transfer can be reduced and compression efficiency of the lower-stage compression part 30 can be improved accordingly. Also, by introducing a gas in the process of compression in the higher-stage compression part 40 into the insulation space 24, deflection of the flat plate 21 can be minimized, and leakage from between the spiral ridges 22*a*, 22*b* and 32, 42 can be minimized. In the case of FIG. 5, the flat plate 21 is divided into halves by an imaginary plane parallel to the faces of the flat plate 21 so that the insulation space 24 is formed in between. Division faces of the flat plate 21 are bonded together around the insulation space 24**.

Figure 6A:
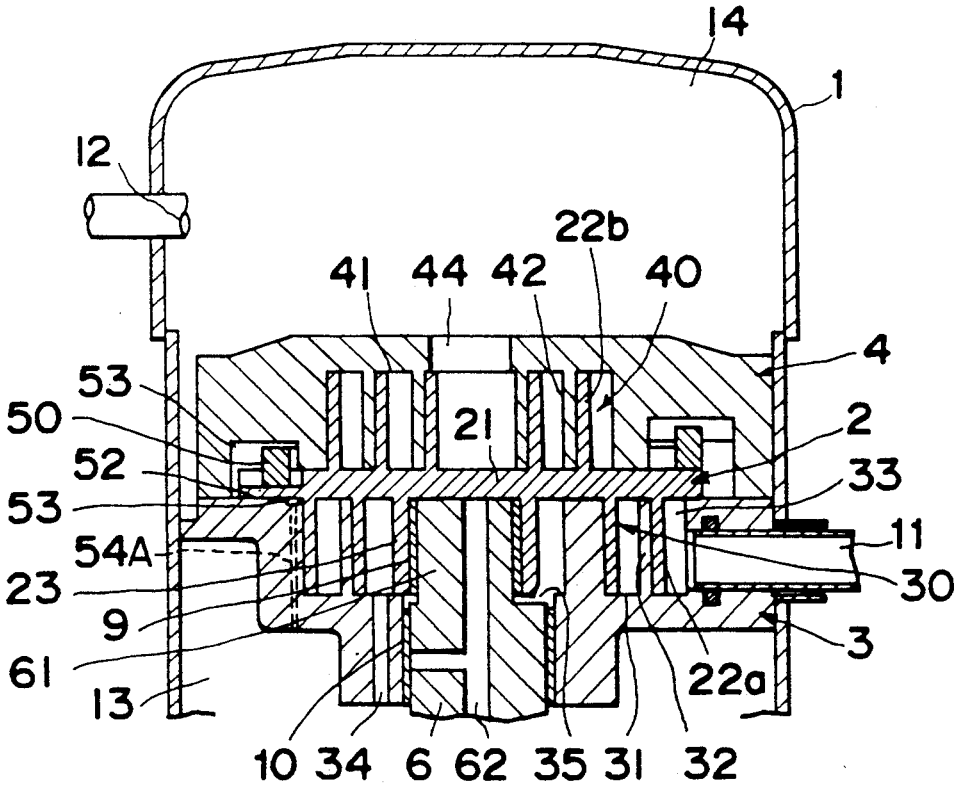
FIGS. 6A–6D are a partial longitudinal sectional views of other variants of the first embodiment of the present invention.
Figure 6B:
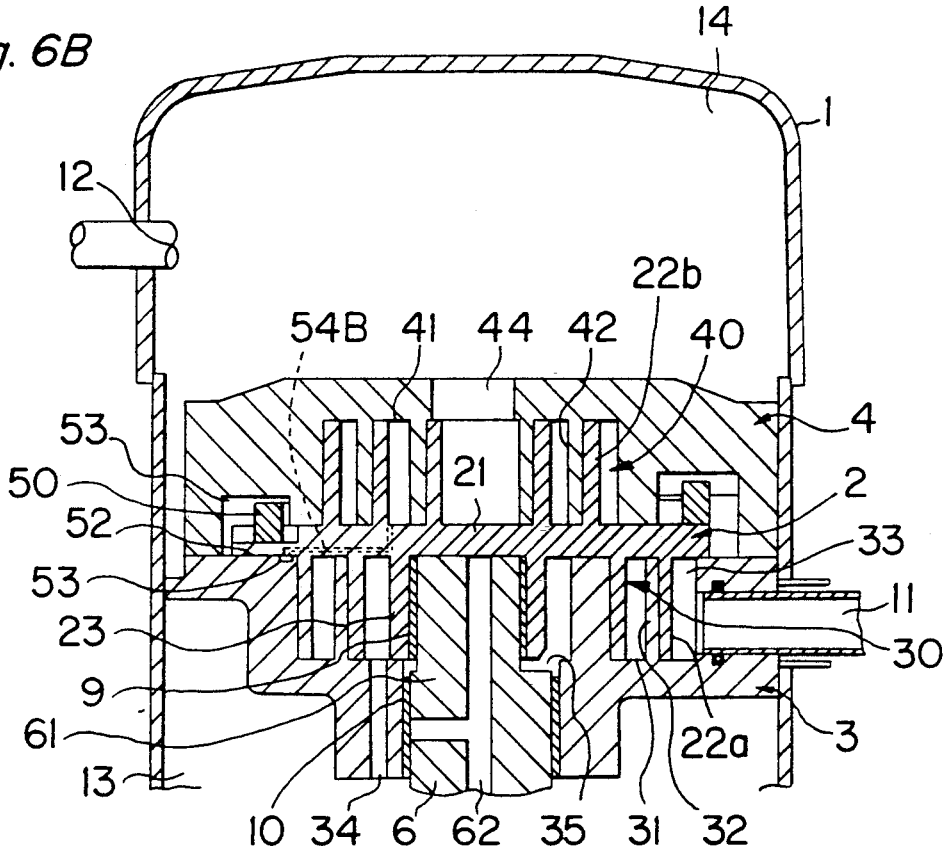
Figure 6C:
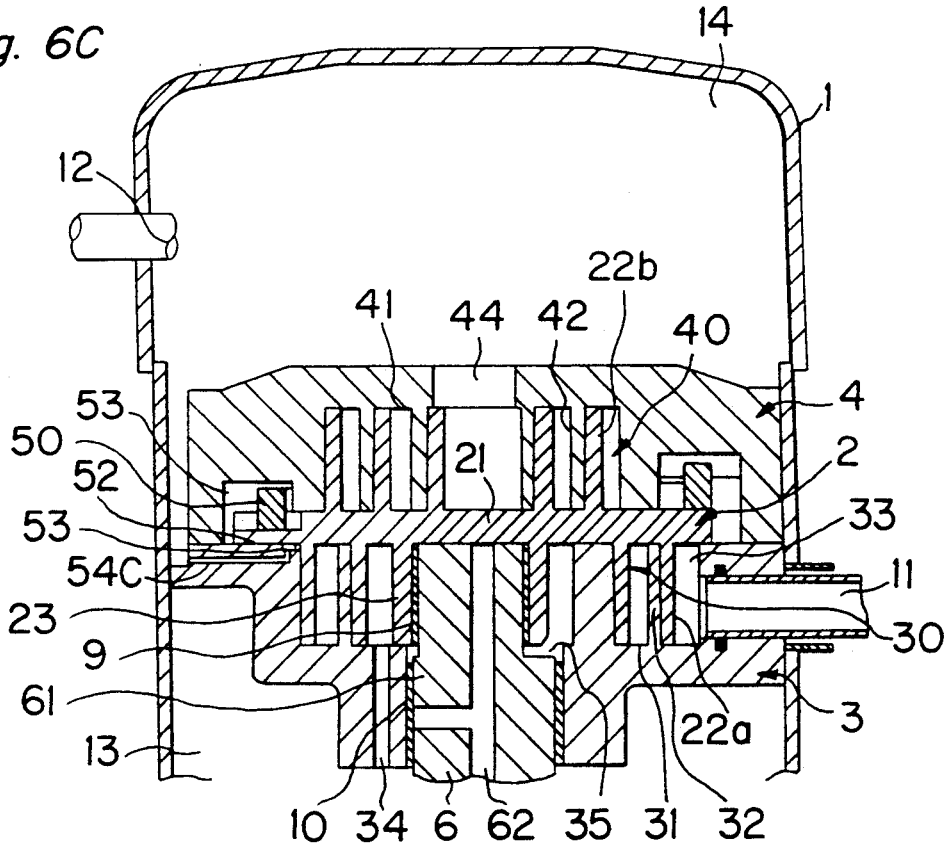

In the first embodiment described above and shown in FIG. 1, the partition wall 8 is provided to form the high-pressure space 14 in the hermetic casing 1. Alternatively, as shown in FIGS. 6A–6D, the second scroll 3 may be formed in a size corresponding to the inner diameter of the casing 1 and fixed to the casing 1 so that the high pressure space 14 is formed. In this case, it is preferable to form an annular pressure chamber 53 in the thrust bearing portion 52 of the first scroll 2 and communicate the pressure chamber 53 to the internal space 13 as shown in FIG. 6A, the compression chamber of the higher-stage compression part 40 as shown in FIG. 6B, or the high-pressure space 14 as shown in FIG. 6C through a communication passage 54A, 54B or 54C, respectively, so as to introduce the intermediate-pressure gas or the high-pressure gas into this pressure chamber 53 for further reduction of the thrust load acting on the first scroll 2.

Figure 6D:
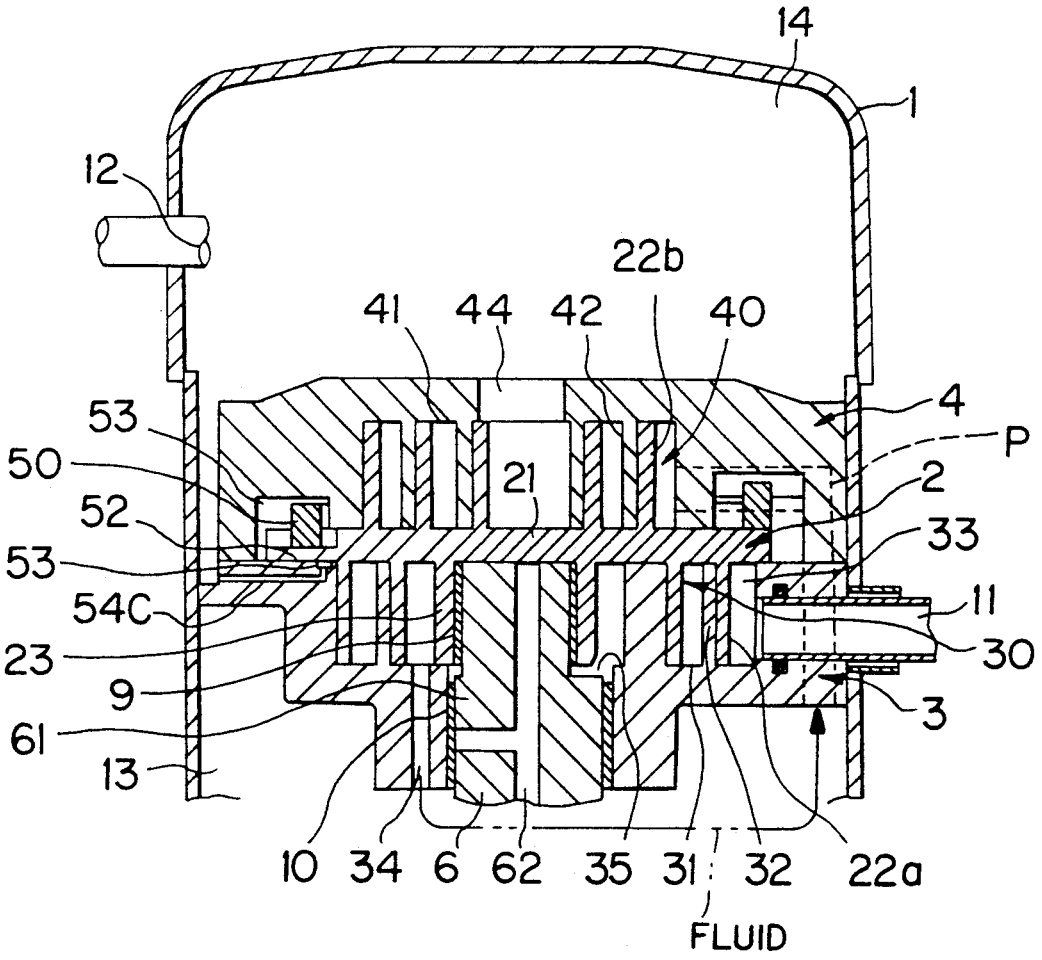

In the embodiments of FIGS. 6A–6C, an intermediate-pressure gas discharged from the discharge port 34 is transferred to the higher-stage compression part 40 through a passage P, as shown in FIG. 6D, connecting the internal space to a suction port (outer peripheral portion) of the higher-stage compression part 40. The passage P is provided in an outer peripheral portion (flange portion) of the second scroll 3 and an outer peripheral portion (flange portion) of the third scroll 4.

Subsequently, a second embodiment shown in FIG. 7 will be described below. The second embodiment is different from the first embodiment in the following points. In the embodiment shown in FIG. 7, a communication passage 26 communicating the discharge port 34 of the lower-stage compression part 30 with the suction port 43 of the higher-stage compression part 40 is provided in the flat plate 21 of the first scroll 2 and the partition wall 8 is eliminated, so that the discharge port 44 of the higher-stage compression part 40 opens into the internal space 13 of the casing 1 and that the internal space 13 is thereby held at a high pressure.

Figure 7:
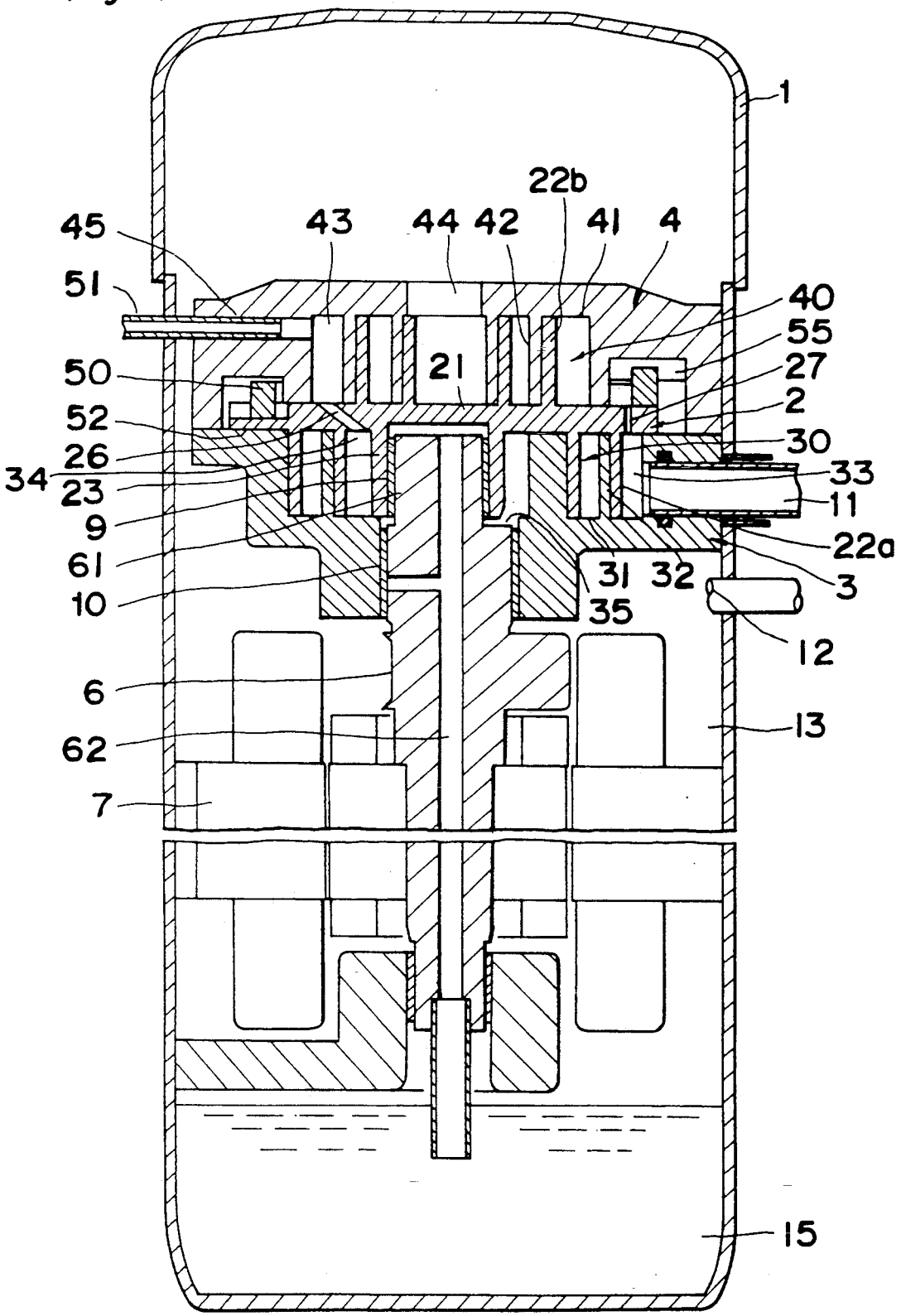
FIG. 7 is a longitudinal sectional view of a second embodiment of the present invention.

Also, in the second embodiment of FIG. 7, an enclosed accommodation space 55 is provided among outer peripheral portions of the scrolls 2, 3 and 4 so as to receive the Oldham joint 50 therein, and the flat plate 21 is provided with a pressure equalizing passage 27 communicating the accommodation space 55 with the suction port 33 of the lower-stage compression part 30. Also, the elastic support means 5 is removed and the third scroll 4 is fixed to the casing 1. The third scroll 4 is provided with a fitting hole 45 which opens into the suction port 43 and which receives the injection tube 51. The discharge passage 12 opens into the internal space 13, so that the casing 1 becomes a high-pressure dome. Reference numeral 15 is an oil reservoir provided in the bottom portion of the internal space 13.

Since the compressor constructed as shown in FIG. 7 is provided with the communication passage 26 in the flat plate 21 of the first scroll 2, the intermediate-pressure gas discharged from the discharge port 34 of the lower-stage compression part 30 through revolution of the first scroll 2 is directly sucked into the suction port 43 through the communication passage 26. The gas is then compressed in the compression chamber of the higher-stage compression part 40 and then discharged into the internal space 13 from the discharge port 44. Therefore, the internal space 13 is held at a high pressure.

Since the internal space 13 is at a high pressure, oil in the oil reservoir 15 can be supplied via the oil supply passage 62 to respective bearings 9, 10 by the differential pressure, without using an oil pump, unlike the first embodiment. Furthermore, oil in the oil supply passage 62 can be easily injected from the communication passage 35 to the lower-stage compression part 30 by the pressure difference between the high pressure in the oil supply passage 62 and the intermediate pressure of the lower-stage compression part 30. Furthermore, since a space confronting an end face of the drive shaft 6 within the boss portion 23 can be held at a high pressure nearly equal to the discharge pressure of the higher-stage compression part 40, the thrust load of the first scroll 2 can be further reduced.

Furthermore, since gas or oil can be injected from the injection tube 51 into the suction port 43 of the higher-stage compression part 40, the gas or oil injection is stably effected at a stable differential pressure between the injection pressure of the injection tube 51 and the intermediate pressure of the suction port 43 having no pressure fluctuations.

Furthermore, since the accommodation space 55 can be uniformly held at a low pressure by means of the introduction of the low-pressure gas on the suction passage 11 into the accommodation space 55 via the pressure equalizing passage 27, the thrust load acting on the first scroll 2 can be further reduced.

Figure 8:
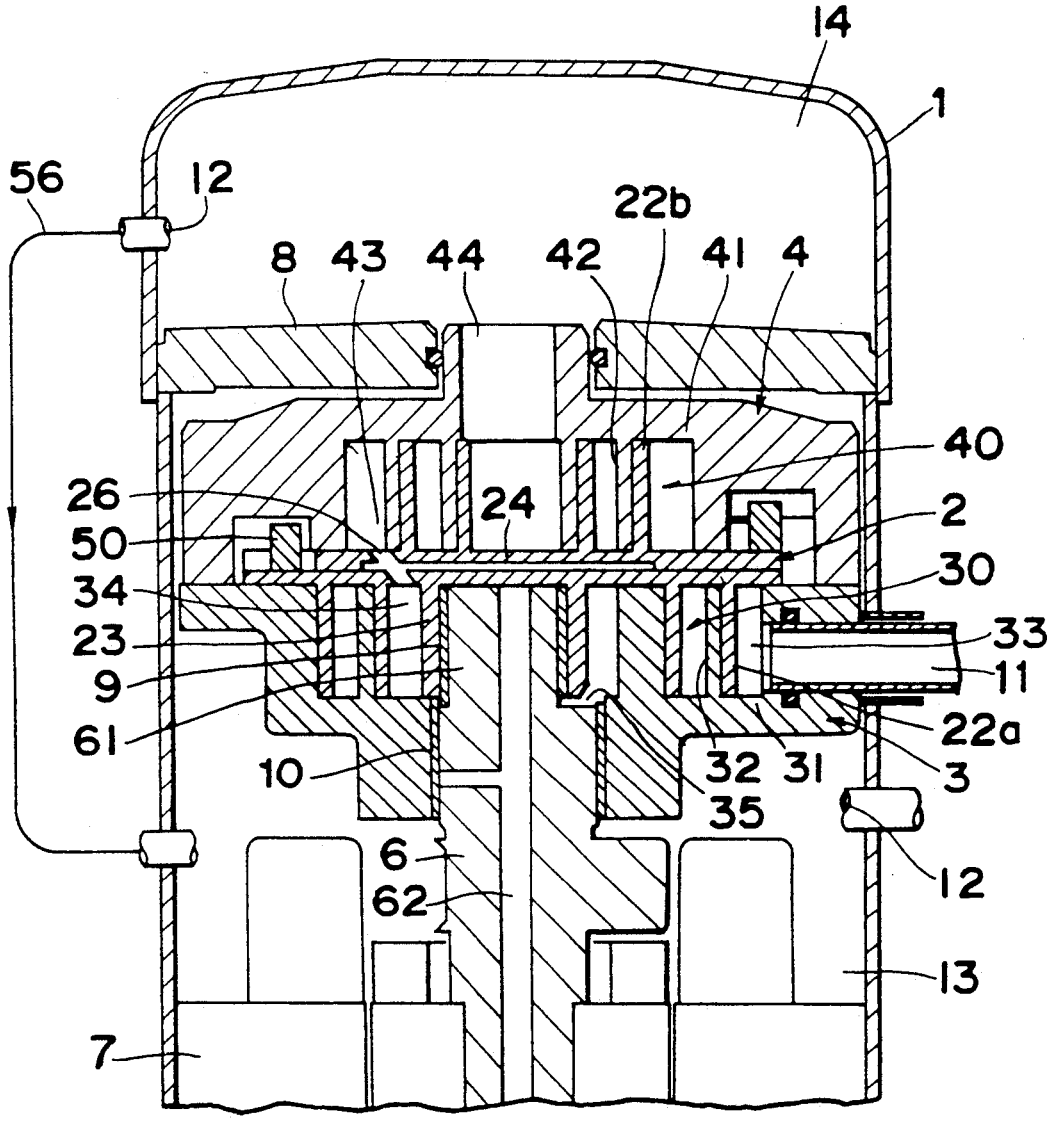
FIG. 8 is a partial longitudinal sectional view of a variant of the second embodiment of the present invention.
Figure 9:
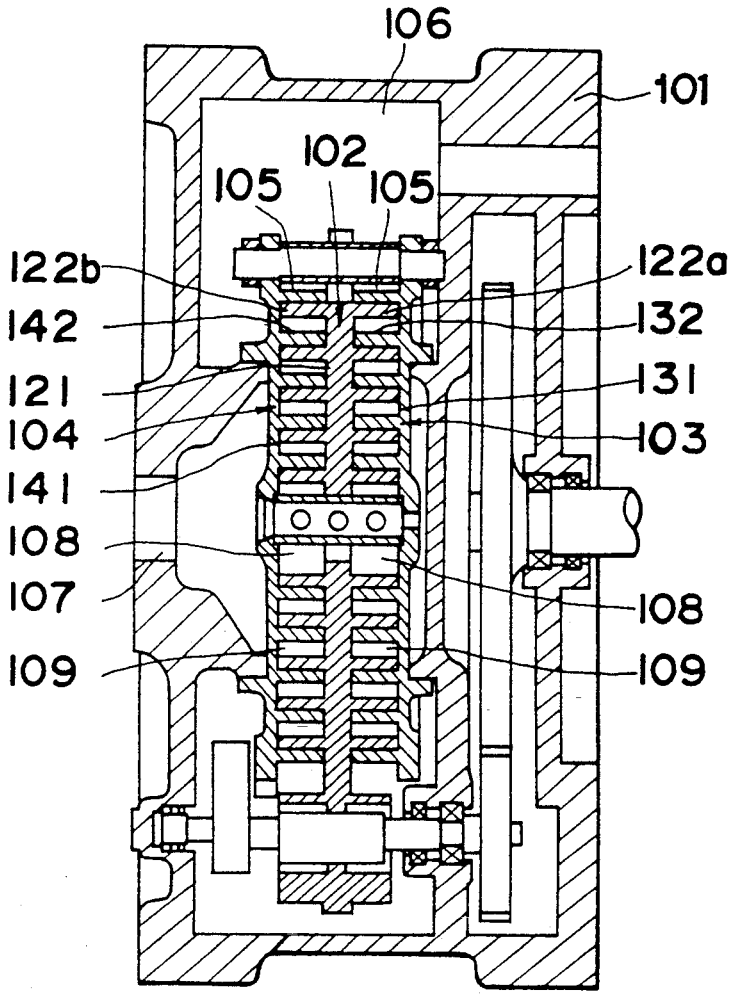
Fig. 9 PRIOR ART
FIG. 9 is a sectional view of a conventional scroll compressor.
Figure 10:
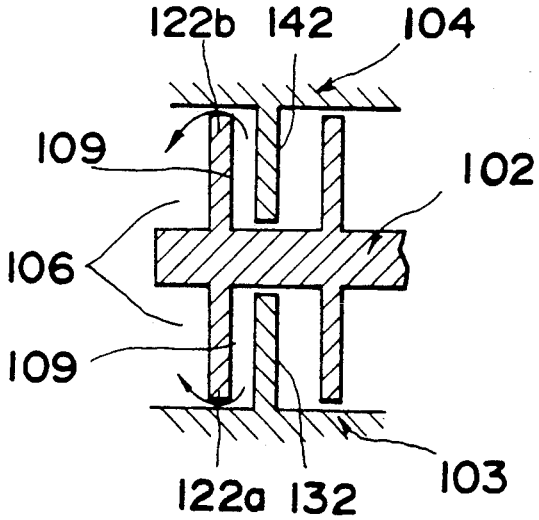
Fig. 10 PRIOR ART
FIG. 10 is an enlarged sectional view of a part of the conventional scroll compressor of FIG. 9.

The second embodiment of FIG. 7 can be varied as shown in FIG. 8. Specifically, a partition wall 8 is provided in the casing 1 to form the high-pressure space 14. This space 14 is communicated with the internal space 13 by a bypass line 56 so as to hold the internal space 13 at a high pressure. Furthermore, similarly to the embodiment shown in FIG. 5, a heat insulation space 24 of a size nearly equal to the outer diameters of the spiral ridges **22*b*, 42 is provided in the flat plate 21 of the first scroll 2. The heat insulation space 24 communicates with the communication passage 26 so that part of the intermediate-pressure gas discharged from the discharge port 34 of the lower-stage compression part 30 to the communication passage 26 is introduced to the heat insulation space 24 so that heat generated during the compression operation at the higher-stage compression part 40 will not be easily transmitted to the lower-stage compression part 30. In this case, the flat plate 21 is, similarly to the flat plate of FIG. 5, divided into two parts in the middle of its thickness to form the heat insulation space 24 inside the flat plate 21, the two divided parts being bonded together around the heat insulation space 24**.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A scroll compressor comprising:

a first scroll having a flat plate and first and second spiral ridges provided on opposite faces of the flat plate, said first scroll being drivably mounted on a drive shaft connected to a motor;

a second scroll having an end plate with a flat face and a spiral ridge provided on the flat face of the end plate, the second scroll being placed on one side of the first scroll so that the flat face of the end plate is opposed to one face of the flat plate of the first scroll and that the spiral ridge of the second scroll is meshed with the first spiral ridge of the first scroll; and a third scroll having an end plate with a flat face and a spiral ridge provided on the flat face of the end plate of the third scroll, the third scroll being placed on the other side of the first scroll so that the flat face of the end plate of the third scroll is opposed to the other face of the flat plate of the first scroll and that the spiral ridge of the third scroll is meshed with the second spiral ridge of the first scroll; and a casing accommodating the first, second and third scrolls and having an internal space therein;

a suction passage for introducing a fluid to be compressed into the casing; and a discharge passage for discharging the fluid out of the casing after the fluid is compressed, characterized in that:

a lower-stage compression part provided with a suction port and a discharge port is formed between the first and second scrolls, the suction port of the lower-stage compression part being formed in the vicinity of external end portions of the first spiral ridge of the first scroll and the spiral ridge of the second scroll and communicating with the suction passage;

a higher-stage compression part provided with a suction port and a discharge port is formed between the first and third scrolls, the suction port of the higher-stage compression part being formed in the vicinity of the external portions of the second spiral ridge of the first scroll and the spiral ridge of the third scroll, the discharge port of the higher-stage compression part being formed in the vicinity of internal end portions of the second spiral ridge of the first scroll and the spiral ridge of the third scroll and communicating with the discharge passage; and a discharge port of the lower-stage compression part communicates with the suction port of the higher-stage compression part, whereby the fluid is first compressed to a predetermined intermediate pressure at the lower-stage compression part and then the fluid is further compressed to a higher pressure at the higher-stage compression part.

2. The scroll compressor as claimed in claim 1, wherein the discharge port of the lower-stage compression part and the suction port of the higher-stage compression part open into the casing accommodating the lower-stage compression part and higher-stage compression part so that the discharge port of the lower-stage compression part and the suction port of the higher-stage compression part communicate with each other through the internal space of the casing, and the discharge port of the higher-stage compression part communicates with the discharge passage while being separated from the internal space.

3. The scroll compressor as claimed in claim 2, wherein an inside of the casing is partitioned by a partition wall into the internal space and a space into which the discharge port of the higher-stage compression part opens.

4. The scroll compressor as claimed in claim 2, wherein the second scroll has a size corresponding to an inner diameter of the casing and is fixed to an inner wall of the casing so that an inside of the casing is partitioned by the second scroll into the internal space and a space into which the discharge port of the higher-stage compression part opens.

5. The scroll compressor as claimed in claim 1, wherein a heat insulation space is formed inside the flat plate of the first scroll so that heat transfer from the higher-stage compression part to the lower-stage compression part is suppressed.

6. The scroll compressor as claimed in claim 5, wherein the heat insulation space communicates with the higher-stage compression part through a communication passage formed in the flat plate of the first scroll.

7. The scroll compressor as claimed in claim 1, wherein the flat plate of the first scroll is provided with a communication passage for communicating the discharge port of the lower-stage compression part with the suction port of the higher-stage compression part, and the discharge port of the higher-stage compression part opens into the internal space of the casing accommodating therein the lower-stage compression part and the higher-stage compression part.

8. The scroll compressor as claimed in claim 7, wherein an inside of the casing is partitioned by a partition wall into the internal space and a space into which the discharge port of the higher-stage compression part opens, these two spaces communicating with each other through a bypass line.

9. The scroll compressor as claimed in claim 7, wherein a heat insulation space is formed inside the flat plate of the first scroll so that heat transfer from the higher-stage compression part to the lower-stage compression part is suppressed.

10. The scroll compressor as claimed in claim 9, wherein the heat insulation space communicates with the communication passage.

* * * * *